US008578547B1

(12) United States Patent
Hollenbach

(10) Patent No.: US 8,578,547 B1
(45) Date of Patent: Nov. 12, 2013

(54) SCUFF MARK REMOVER DEVICE

(71) Applicant: Rosanne L. Hollenbach, St. Cloud, MN (US)

(72) Inventor: Rosanne L. Hollenbach, St. Cloud, MN (US)

( * ) Notice: Subject to any disclaimer, the term of this patent is extended or adjusted under 35 U.S.C. 154(b) by 0 days.

(21) Appl. No.: 13/731,924

(22) Filed: Dec. 31, 2012

(51) Int. Cl.
*A47L 13/10* (2006.01)

(52) U.S. Cl.
USPC ..... 15/209.1; 15/104.001; 15/210.1

(58) Field of Classification Search
USPC ..... 15/209.1, 210.1, 229.11–229.13, 15/104.001, 160, 228, 145, 176.2
See application file for complete search history.

(56) References Cited

U.S. PATENT DOCUMENTS

| | | | | |
|---|---|---|---|---|
| 6,668,414 | B1 * | 12/2003 | Benjamin, Jr. | 15/104.001 |
| 6,833,034 | B1 * | 12/2004 | Thomas, Jr. | 134/6 |
| 2004/0040105 | A1 * | 3/2004 | Hillenbrand | 15/104.001 |
| 2006/0207045 | A1 * | 9/2006 | Pyka et al. | 15/209.1 |
| 2007/0169296 | A1 * | 7/2007 | McDonald | 15/209.1 |

* cited by examiner

*Primary Examiner* — Shay Karls
(74) *Attorney, Agent, or Firm* — Dave Alan Lingbeck

(57) ABSTRACT

A scuff mark remover device for effectively and economically removing scuff marks from accommodating floors. The scuff mark remover device includes a support assembly including an elongate support member having an end; and a scuff removing member being removably retained adjacent to the end of the elongate support member.

3 Claims, 2 Drawing Sheets

SCUFF MARK REMOVER DEVICE

BACKGROUND OF THE INVENTION

1. Field of the Invention

The present invention relates to mark removers and more particularly pertains to a new scuff mark remover device for effectively and economically removing scuff marks from accommodating floors.

2. Description of the Prior Art

The use of mark removers is known in the prior art. More specifically, mark removers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a scuff mark removal tool for removing scuff marks from tile floors with little effort. The scuff mark removal tool includes a flexible ball member having a wall and being adapted to remove scuff marks from a tile floor; and also includes an elongate handle member being removably and securely engaged to the flexible ball member. Another prior art includes a scuff mark removal tool used to remove tar, dirt, and rubber scuff marks from an uncarpeted floor surface. The tool has a handle portion and a felt-covered ball attached to the handle portion. The felt-covering on the ball effectively removes the scuff marks when rubbed against the marks without scratching the floor surface. Also another prior art includes Scuff Remover Device with a stick like handle, a hollow, spherical ball shape having a size and outside surface similar to that of a standard tennis ball. A connection collar joins one end of the stick handle to the ball shape and an adhesive material connects the collar to the ball shape. While these devices fulfill their respective, particular objectives and requirements, the aforementioned patents do not disclose a new scuff mark remover device.

SUMMARY OF THE INVENTION

The general purpose of the present invention, which will be described subsequently in greater detail, is to provide a new scuff mark remover device which has many of the advantages of the mark removers mentioned heretofore and many novel features that result in a new scuff mark remover device which is not anticipated, rendered obvious, suggested, or even implied by any of the prior art mark removers, either alone or in any combination thereof. The present invention includes a support assembly including an elongate support member having an end; and a scuff removing member being removably retained adjacent to the end of the elongate support member. None of the prior art includes the combination of the elements of the present invention.

There has thus been outlined, rather broadly, the more important features of the scuff mark remover device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new scuff mark remover device which has many of the advantages of the mark removers mentioned heretofore and many novel features that result in a new scuff mark remover device which is not anticipated, rendered obvious, suggested, or even implied by any of the prior art mark removers, either alone or in any combination thereof.

Still another object of the present invention is to provide a new scuff mark remover device for cost effectively and economically removing scuff marks from accommodating floors.

Still yet another object of the present invention is to provide a new scuff mark remover device that allows the user to use the entire surface of the tennis ball to remove scuff marks thus saving a lot of money without having to use chemicals which are expensive and dangerous and also without having to replace the tennis ball after one single use thereof.

Even still another object of the present invention is to provide a new scuff mark remover device that allows the user to easily reposition the tennis ball as needed to use any of the surface area of the ball.

These together with other objects of the invention, along with the various features of novelty which characterize the invention, are a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
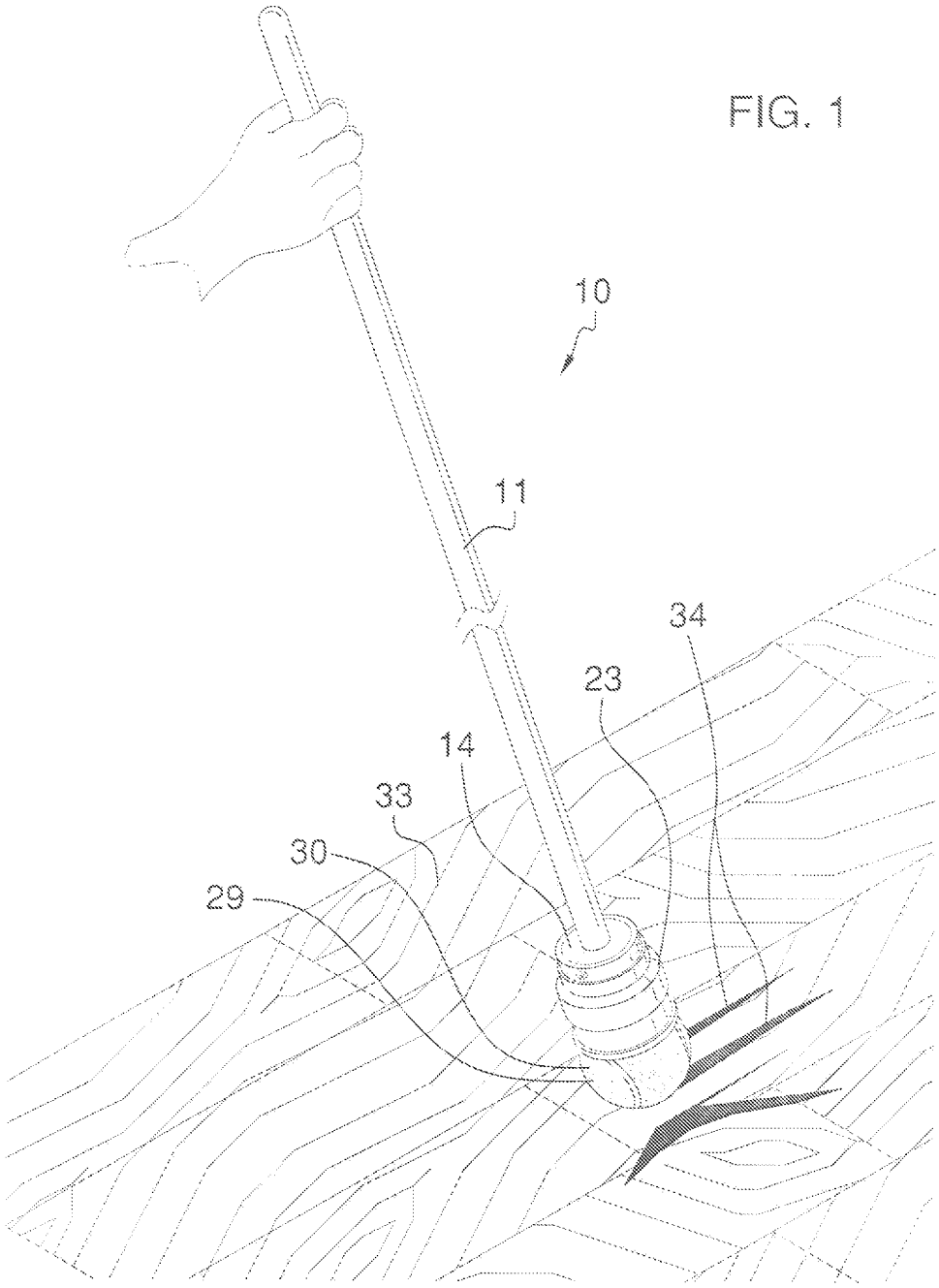
FIG. 1 is a perspective view of a new scuff mark remover device being in use and according to the present invention.
Figure 2:
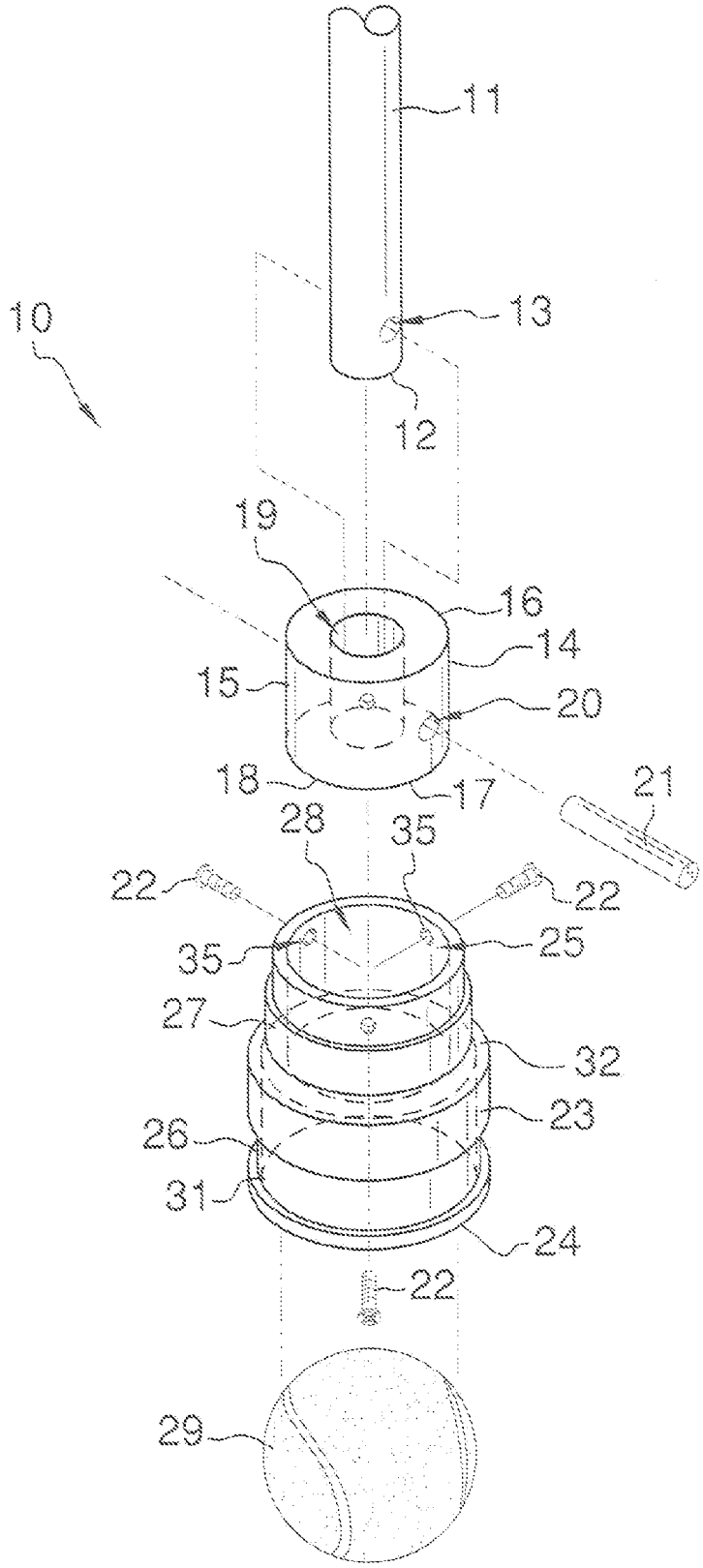
FIG. 2 is an exploded perspective view of the present invention.

With reference now to the drawings, and in particular to FIGS. 1 through 2 thereof, a new scuff mark remover device embodying the principles and concepts of the present invention and generally designated by the reference numeral 10 will be described.

As best illustrated in FIGS. 1 through 2, the scuff mark remover device 10 generally comprises a support assembly including an elongate support member 11 having an end 12; and a scuff removing member 29 being removably retained adjacent to the end 12 of the elongate support member 11. The elongate support member 11 has a bore 13 disposed transversely therein near the end 12 of the elongate support member 11. The elongate support member 11 is generally a pole having a length.

The support assembly also includes an abutment member 14 being in communication with the end 12 of the elongate support member 11. The abutment member 14 is a cylindrical member having a side 15, a first end 17, and a second end 16 having a bore 19 disposed therein. The end 12 of the elongate support member 11 is securely received and fastened in the bore 19 to securely retain the cylindrical member to the elongate support member 11. The first end 17 of the cylindrical member has a surface 18 which is generally disposed perpendicular to a longitudinal axis of the elongate support member 11 and is faced away from the elongate support member 11. The scuff removing member 29 is in contactable relationship with the first end 17 upon the scuff removing member 29 being retained adjacent to the end 12 of the elongate support member 11. The cylindrical member has a plurality of holes 20 being disposed in the side 15 thereof with a fastening member 21 being disposed in one of the holes 20 of the cylindrical member and in the bore 13 of the elongate support member 11 to securely retain and fasten the cylindrical member to the elongate support member 11.

The support assembly also includes a flexible and resilient socket member 23 being securely disposed about the abutment member 14. The scuff removing member 29 is removably retained by the socket member 23. The socket member 23 is generally a tubular member having open first and second ends 24,25 and having a bore 28 extending therethrough and having a flexible and resilient side wall 31. The socket member 23 has a first portion 26 and second portion 27. The first portion 26 has a greater circumference than that of the second portion 27. The bore 28 passing through the first portion 26 has a greater circumference than of the bore 28 passing through the second portion 27 with an annular ledge 32 being formed in the bore 28 and separating the first portion 26 from the second portion 27. The second portion 27 has a plurality of holes 35 being disposed through the second portion 27 near the open second end 25 and is fastened with fasteners 22 to the abutment member 14.

The scuff removing member 29 is a flexible ball having a felt covering 30. The ball is removably received and retained in the socket member 23 with at least a portion of the ball being exposed beyond the open first end 24 of the socket member 23 and is not hindered by any of the support assembly so that the exposed portion of the ball can engage a non-carpeted floor surface 33. The side wall 31 at the open first end 24 of the socket member 23 is biasedly engaged about a portion and a circumference of the ball to removably hold and retain the ball to the socket member 23. At least ½ the ball is removably retained within the bore 28 of the socket member 23.

In use, the user inserts the ball into the open first end of the socket member 23 where the ball is retained and a portion of the ball is exposed beyond the open first end 24 of the socket member 23. The user then grasps the elongate support member 11 and rubs the ball on a scuff mark 34 on the floor surface 33; whereupon, the felt-covering 30 about the ball effectively removes the scuff mark 34 from the floor surface 33. After that particular surface of the ball is used and worn instead of throwing away the ball, the user simply rotates the ball to have a new and unused surface of ball exposed for scrubbing on the floor surface 33. The user can use every part of the surface of the ball to remove scuff marks thus saving the user a lot of money in the process.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the scuff mark remover device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scuff mark remover device comprising:

a support assembly including an elongate support member having an end, wherein said support assembly also includes a flexible and resilient socket member, wherein said socket member is generally a tubular member having open first and second ends and a bore extending therethrough and also having a flexible and resilient side wall; and a scuff removing member being removably retained adjacent to said end of said elongate support member, wherein said scuff removing member is a ball, wherein said ball is removably received and retained in said socket member with at least a portion of said ball being exposed beyond said open first end of said socket member to engage a floor surface when being used to remove scuff marks, wherein said side wall at said open first end of said socket member is biasedly engaged about a portion of said ball to removably hold and retain said ball to said socket member.

2. The scuff mark remover device as described in claim 1, wherein said side wall at said open first end of said socket member is biased about a circumference of said ball to removably hold and retain said ball to said socket member.

3. The scuff mark remover device as described in claim 2, wherein at least ½ of said ball is removably and securely disposed within said socket member.

* * * * *